US007739975B1

(12) United States Patent
Manderfeld

(10) Patent No.: US 7,739,975 B1
(45) Date of Patent: Jun. 22, 2010

(54) ROLL FORMED PONTOON AND METHOD OF MANUFACTURE

(76) Inventor: Raymond M. Manderfeld, 50600 Wyandotte Dr., Granger, IN (US) 46530

( * ) Notice: Subject to any disclaimer, the term of this patent is extended or adjusted under 35 U.S.C. 154(b) by 0 days.

(21) Appl. No.: 12/165,926

(22) Filed: Jul. 1, 2008

(51) Int. Cl.
*B63B 1/00* (2006.01)

(52) U.S. Cl. ..... 114/292; 114/356

(58) Field of Classification Search ..... 114/61.1, 114/61.2, 292, 356, 352, 357; 72/51; 228/147, 228/158
See application file for complete search history.

(56) References Cited

U.S. PATENT DOCUMENTS 2,977,914 A 4/1961 Gray et al.
3,783,497 A * 1/1974 Griesinger ..... 72/51
5,474,227 A * 12/1995 Krengel et al. ..... 228/147
5,732,874 A * 3/1998 Borzym et al. ..... 228/147
5,988,087 A 11/1999 Pepper
6,644,229 B1 11/2003 Davenport
6,898,955 B1 5/2005 Davenport

FOREIGN PATENT DOCUMENTS

WO WO 2005/070070 A2 8/2005

* cited by examiner

*Primary Examiner*—Lars A Olson
(74) *Attorney, Agent, or Firm*—Botkin & Hall, LLP

(57) ABSTRACT

A method for making a pontoon for a pontoon boat and the pontoon made from the method. The method having an initial step of providing a sheet metal strip that has a width and a length. The strip is then formed longitudinally through successive rollers to provide a central portion having a closed cross section in which the lateral edges of the strip meet. After this stage of the process, end caps are formed at each end of the central portion. Typically, one of the end caps is a nose cone that is pointed and cuts the water as the boat moves forward. The end caps may be formed independently and separately of the strip or may be formed from material at the end of the formed strip.

19 Claims, 9 Drawing Sheets

ROLL FORMED PONTOON AND METHOD OF MANUFACTURE

BACKGROUND OF THE INVENTION

Pontoon boats are a popular watercraft, and making the pontoons for them has been accomplished by several methods. Whichever method of making a pontoon is used, a pontoon will generally have a straight central portion that comprises most of the length of the pontoon, an end cap that will be a blunt cap attached to the back end of the central portion, and a tapered portion forming a nose cone attached to the front end of the central portion that cuts the water as the boat moves forward. A former method for making pontoons consisted of roll forming short pieces of sheet metal laterally to make short cylinders, and welding a number of short cylinders to make a central portion. In so doing, a number of circumferential welds were produced where each cylinder was welded to an adjacent cylinder. In addition to the welds in the central portion, the end cap and nose cone also require circumferential welds. All of the circumferential welds are potential leak points. If a weld is incomplete or has porosity, water can enter the interior of the pontoon. The circumferential welds also add drag since they are raised relative to the smooth portions of the pontoon.

A more advanced method of making pontoons having fewer circumferential welds is disclosed in U.S. Pat. No. 6,644,229. In this patent, a single piece of sheet metal is inserted into rollers and rolled laterally to form a cylindrical central portion. The central portion made by this method has no circumferential welds between its ends. The length of the cylindrical central portion formed in this process is limited to the width of the rollers. The shape of the central portion produced is also limited to a circular or oval shape due to the configuration of the rollers. Another drawback to this process is that the rollers will bow outward during the rolling process, and the bowing is greater in proportion to longer lengths of the rollers. When the rollers bow, this will produce a central portion that is slightly bowed, which is detrimental to the performance of the pontoon in the water. Ideally a pontoon would be straight along its length and have no circumferential welds below the waterline.

SUMMARY OF THE INVENTION

The present invention is a method for making a pontoon for a pontoon boat and the pontoon made from the method. The method includes an initial step of providing a sheet metal strip that has a width and a length. The strip is then formed longitudinally through successive rollers to provide a central portion having a closed cross section in which the lateral edges of the strip meet. After this stage of the process, end caps are formed at each end of the central portion. Typically one of the end caps is a nose cone that is pointed and cuts the water as the boat moves forward. These ends caps may be formed independently and separately of the strip, or may be formed from material at the end of the formed strip. The edges of the central portion are joined together, and the end caps are joined to the central portion. The joining is typically accomplished by welding.

The cross sectional area of the central portion may be a cylinder as is traditionally used in pontoons or a non-circular shape.

DETAILED DESCRIPTION OF INVENTION

Figure 1:
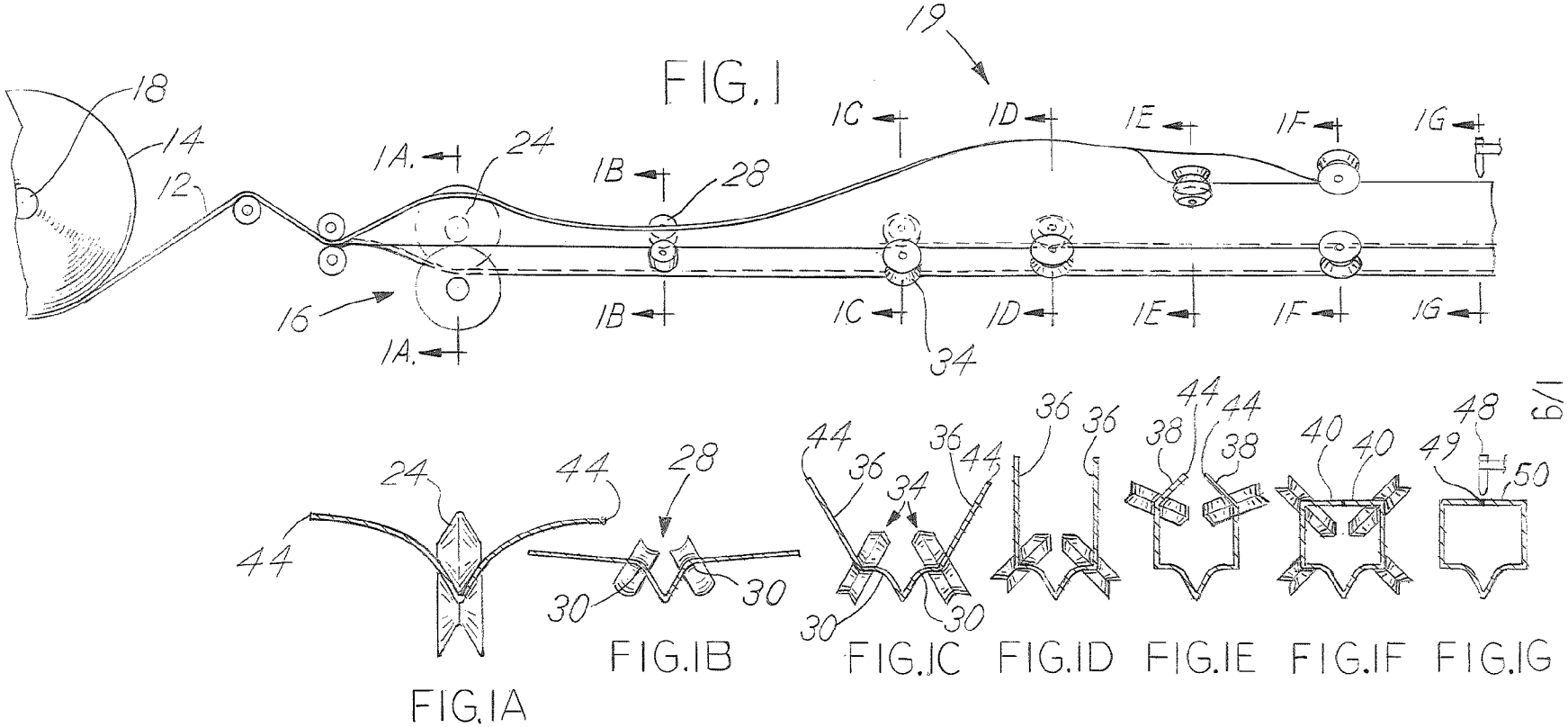
FIG. 1 is a side view of the overall method of the invention.
Figure 2:
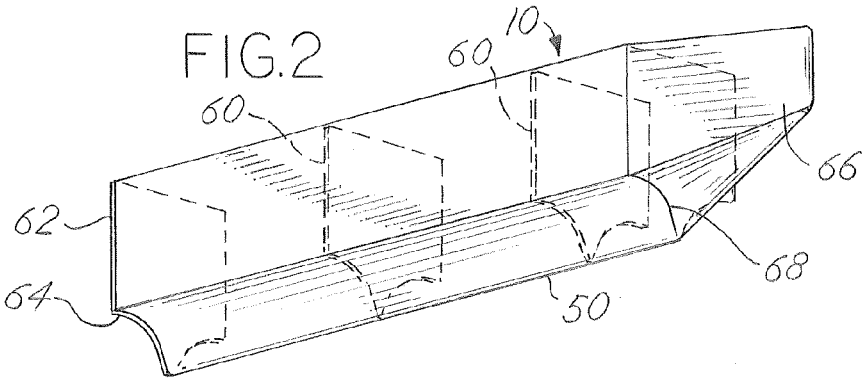
FIG. 2 is a perspective view of a pontoon made by the method of this invention.
Figure 3:
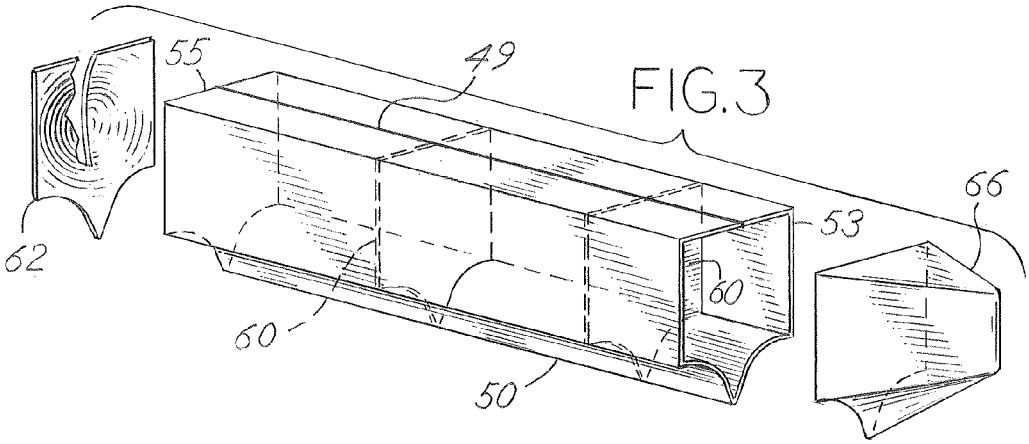
FIG. 3 is an exploded perspective view of the pontoon shown in FIG. 2.
Figure 4:
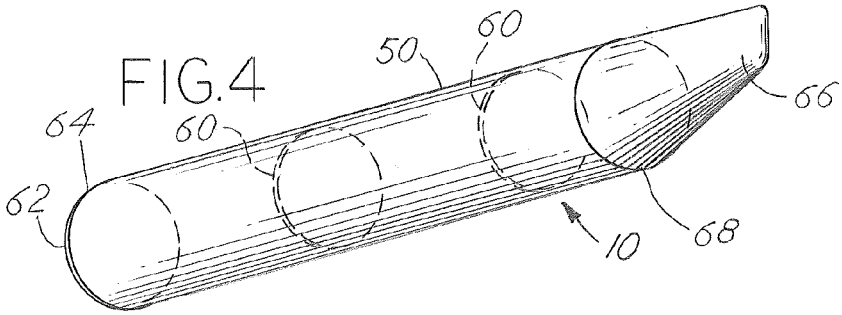
FIG. 4 is a perspective view of another embodiment of a pontoon made by the method of this invention.
Figure 5:
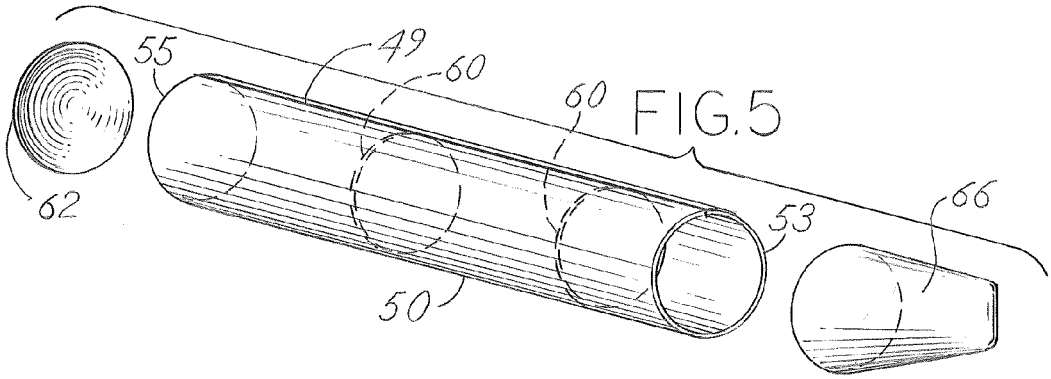
FIG. 5 is an exploded perspective view of the pontoon shown in FIG. 4.

This invention relates to a process for making pontoons 10 for pontoon boats. The process has multiple applications that are similar. A first application of the process for making a pontoon 10 according to this invention is shown in FIGS. 2-5. In either application of the process, the pontoon 10 has a central portion 50, a nose cone 66, and an end cap 62. An exploded view of the pontoon 10 made by the first application method of this invention is shown in FIGS. 4 and 5. A strip 12 of aluminum sheet metal from a coiled roll 14 is fed into a series of rollers 16 longitudinally to form a continuous central portion 50 having a particular cross sectional shape. The roll 14 is supported on an axle 18 that is freely rotatable so that it may be drawn into a roll forming machine 19. FIG. 1 shows the overall process, which can be used to make various cross sectional shapes. Such roll forming machinery is well known in the art.

The roll forming machine 19 is used to produce a central portion 50 of the pontoon 10. FIG. 1 shows a non-circular cross sectional central portion 50 being produced with the method. The method of this invention proceeds from left to right with the beginning step as shown in FIG. 1A toward completion of a central portion 50 as shown in FIG. 1G. As the strip 12 enters the roll forming machine 19 from the coiled roll 14, it will reach a first set of rollers 24 that will bend the strip in a first operation. This is shown in FIG. 1A. This will put a bottom V-bend into the pontoon 10 that will ultimately have a bottom shape with a V-hull. A second set of rollers 28, shown in FIG. 1B, bends the strip outwardly to form a rounded bottom portion 30 on either side of the V-bend. A third set of rollers 34 begins bending sidewalls 36 upward as shown in FIG. 1C. The sidewalls 36 are completed in a subsequent operation shown in FIG. 1D. The upper portions 38 of the sidewalls 36 are folded inward toward each other as shown in FIG. 1E to begin forming what will become the top portions 40 of the pontoon 10. The top of the pontoon 10 is formed in FIG. 1F as the top portions 40 are bent into their final shape.

Once the desired cross section is achieved as shown in FIG. 1F, the lateral edges 44 will meet because the width of the strip 12 is chosen to be the exact perimeter of the cross sectional shape. While the edges 44 are held together, a welder 48 will make a single continuous weld 49 to join the lateral edges 44 as shown in FIG. 1G. After the continuous weld 49 is made for a length that is needed, the formed strip 12 will be cut to form a central portion 50. The central portion 50 may be cut to a desired length and the cross section may be any configuration that may be roll formed. The length of the central portion 50 may be twenty or more feet long and possibly much longer since there is no limit to the length of a central section 50 that may be produced. This is different than prior art roll formed pontoons in which the central sections are limited to the width of the rollers. A completed central portion having a front end 53 and a back end 55 is shown in FIGS. 3 and 5. The cross section may be a non-circular cross section, as shown in FIG. 3, or, if a cylindrical pontoon is desired, a circular cross section as shown in FIG. 5 may be used. When the shape of the pontoon 10 as shown in FIGS. 2 and 3 is used, a substantial savings in producing a pontoon boat can be realized since cross members supporting a deck can be attached directly to the top of the pontoon 10 as opposed to the use of brackets which must be used with cylindrical pontoons. Whichever cross sectional shape is desired, the process will proceed similarly to the one illustrated in FIG. 1 with successive bending operations occurring to form a final desired central portion.

After the forming operation described above, baffles 60 may be added to partition the central portion 50 into separate chambers. The baffles 60 are inset from the ends 53, 55 of the central portion 50 a predetermined distance as shown in phantom in FIGS. 2-5. Each baffle 60 is placed with a watertight seal around its perimeter so that the pontoon 10 is divided into separate watertight chambers. The panels 60 may be welded around the perimeter, or held in place with a suitable epoxy adhesive. This is done as a means to prevent the entire pontoon 10 filling with water if it was punctured.

Once the baffles 60 are in place, an end cap 62 is welded to the back end 55 of the central portion 50 as shown in FIGS. 2 and 4. This requires a weld 64 around the perimeter of the central portion 50. A tapered end cap or nose cone 66 is welded to the front end 53 of the central portion 50 with a weld 68 around the perimeter of the central portion 50. The nose cone 66 need not be a conical shape or revolution, and may be any tapered shape that is streamlined so that the pontoon 10 more easily cuts the water in which it moves.

As the pontoon 10 floats, it will float at a particular depth depending on the weight placed on it, and the water will form a line 65 along the sides of the pontoon 10, which is the waterline. In the case of the pontoon 10 shown in FIG. 2, the pontoon's 10 size is chosen so that when the pontoon 10 carries the full amount of weight placed upon it, the waterline 65 is located at the lower edge of the sidewall 36. In the case of the pontoon 10 shown in FIG. 4, the waterline 65 is above the bottom of the pontoon 10 by approximately one-third of the distance between the top and bottom of the pontoon 10 when the pontoon 10 carries the full amount of weight to be placed upon it. When a pontoon 10 is made according to FIG. 2 or 4, there are only two welds 64, 68 below the waterline when the pontoon 10 is in the water. The continuous weld 49 along the top of the pontoon 10 will be above the waterline 65.

Figure 6:
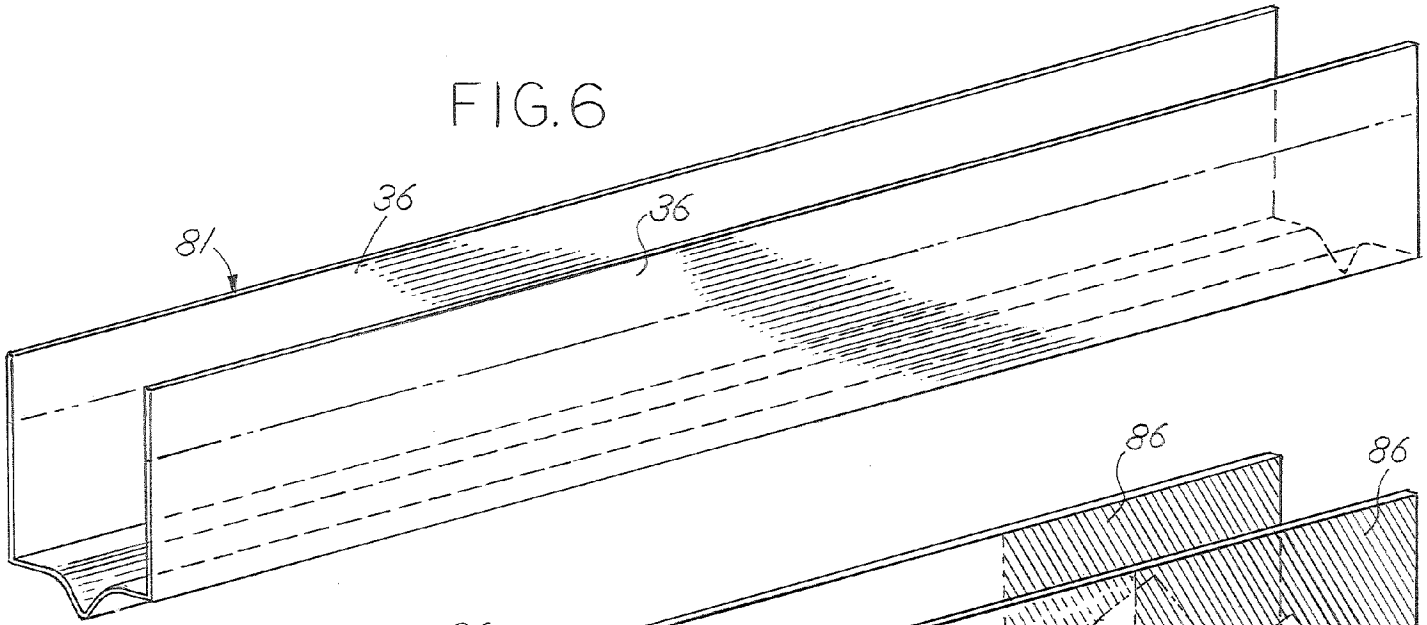
FIG. 6 is a perspective view showing the formed trough used in a second application of the method.
Figure 7:
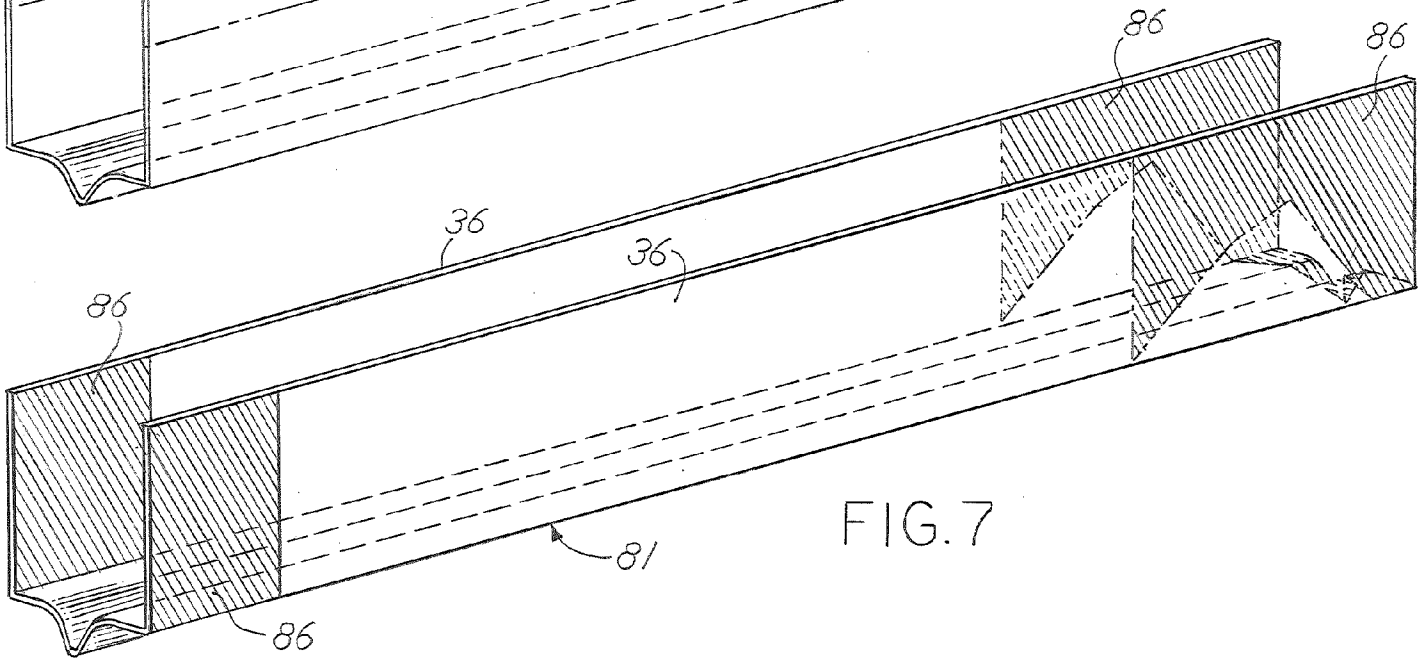
FIG. 7 is a perspective view of the formed trough shown in FIG. 6 with sections to be removed shaded.
Figure 8:
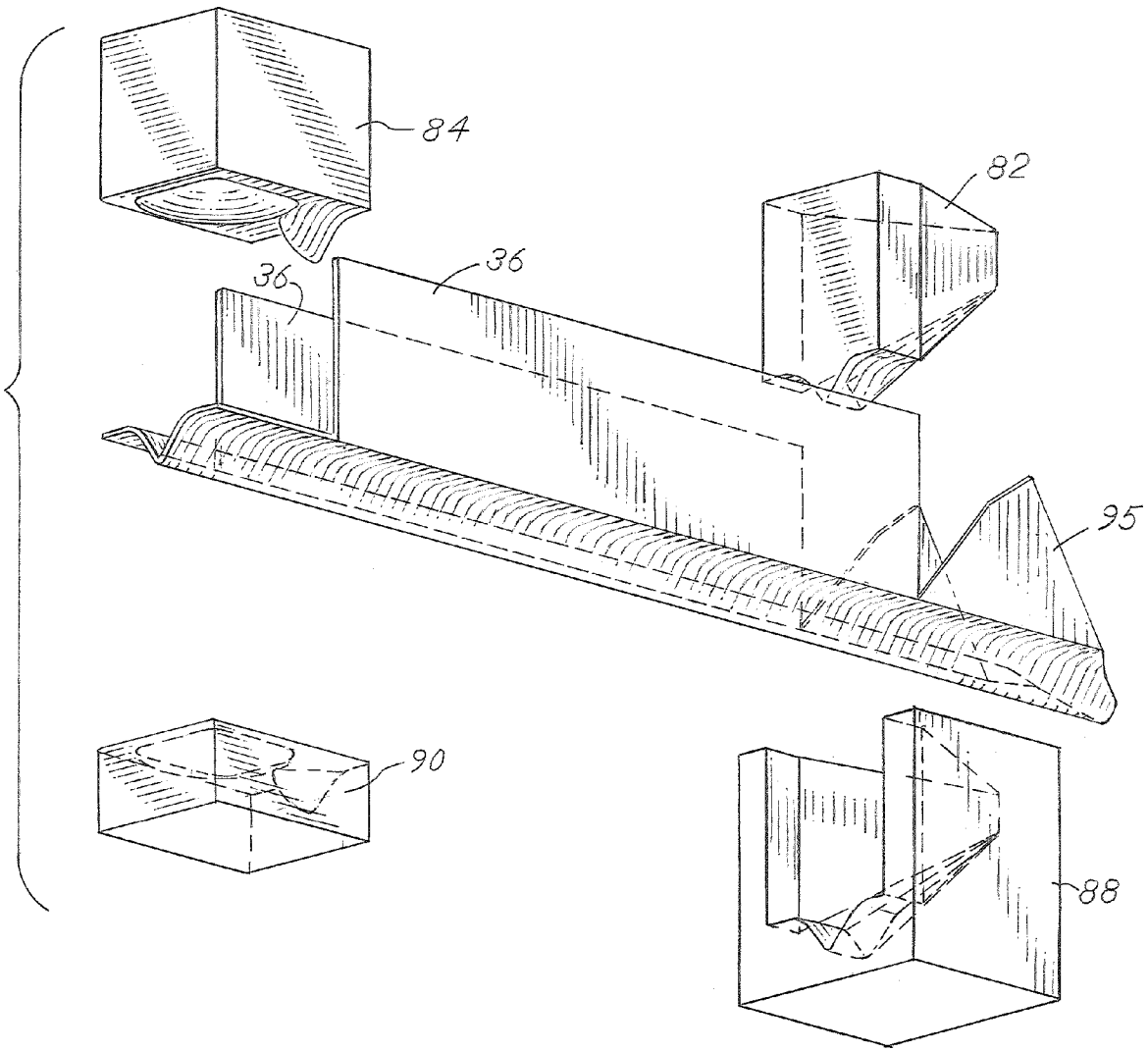
FIG. 8 is a perspective view of the trough shown in FIG. 6 with punches and dies.
Figure 9:
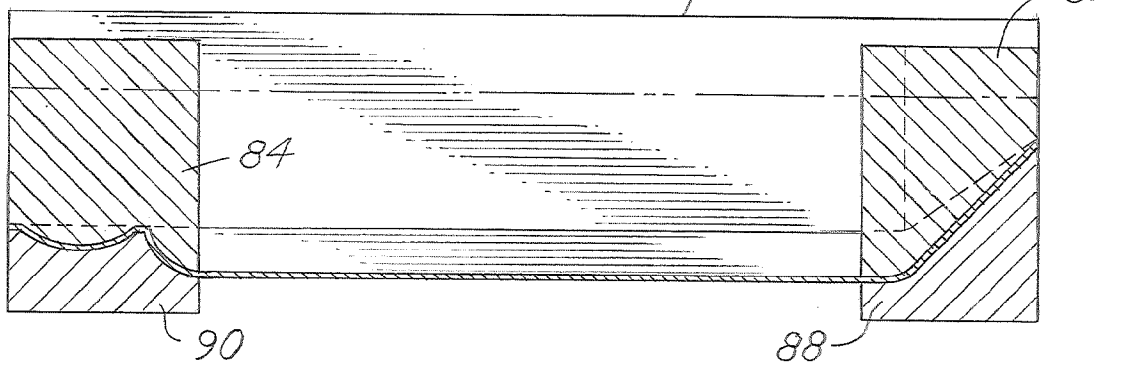
FIG. 9 is a sectional view of the punches and dies shown in FIG. 8 stamping the trough shown in FIG. 6.
Figure 10:
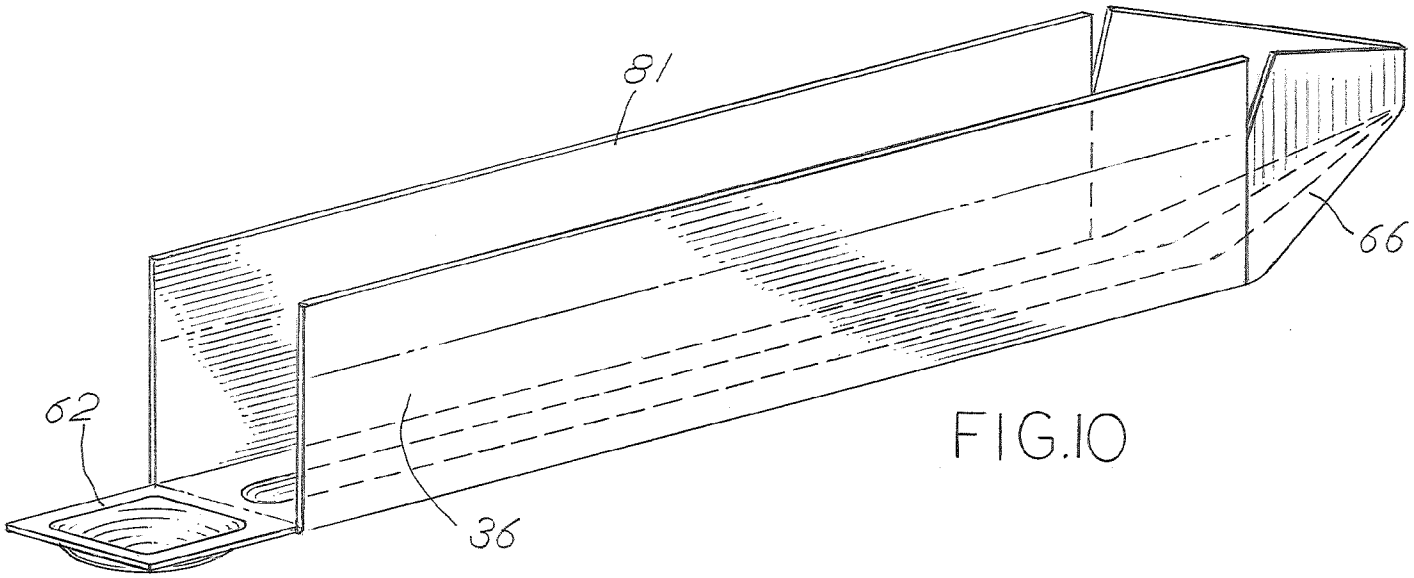
FIG. 10 is a perspective view of a partially formed pontoon.

A second application of the method of this invention may be used to produce a pontoon 80 that has no welds below the waterline. This second application proceeds much the same as the method described above in FIGS. 1-5. However, when the strip is formed to the stage of FIG. 1D, it is cut to a desired length and removed from the forming machine 19 as an open ended trough 81. FIG. 6 shows the trough 81. This length of the trough 81 will be longer than the overall length of the finished pontoon 80 as will become apparent from the further description of the process below. Areas 86 of metal are cut from the sidewalls 36; the areas 86 are shown shaded in FIG. 7. After the areas 86 are removed, the trough 81 is placed in a different machine between a front punch 82 and front die 88, and a rear punch 84 and rear die 90, as shown in FIG. 8. The punches 82, 84, and dies 88, 90 are stamped together to form the rough shape of the nose cone 66 and end cap 62. FIG. 9 shows a sectional view of the compressed dies 88, 80 and punches 82, 84. After the dies 88, 90 and punches 82, 84 are separated, the rough shape of the nose cone 66 and end cap 62 are defined as shown in FIG. 10.

Figure 11:
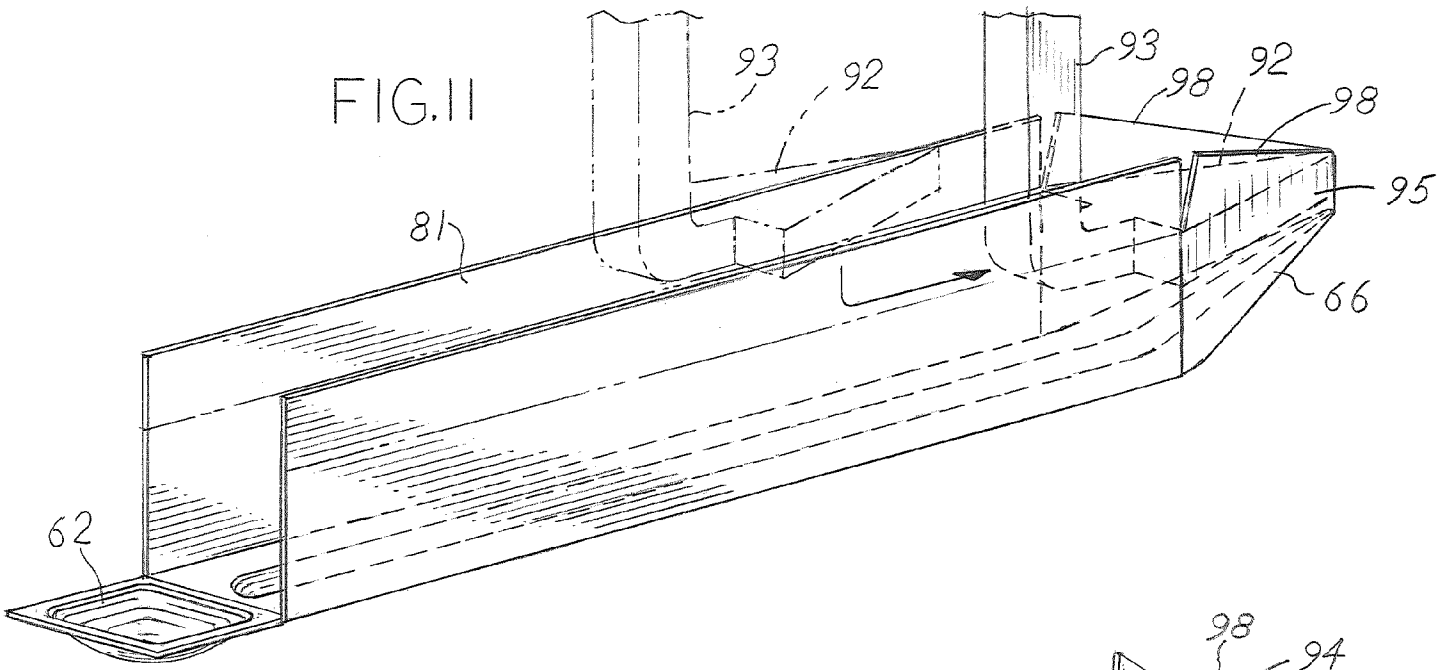
FIG. 11 is a perspective view of a partial die in the nose cone of the trough.
Figure 13:
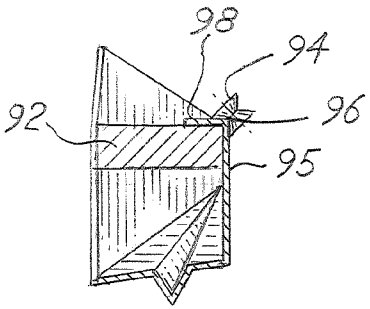
FIG. 13 is a sectional view taken about the line 13-13 in FIG. 12.
Figure 12:
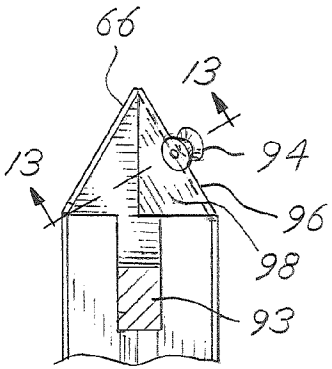
FIG. 12 is a view of a roller forming the trough against the partial die shown in FIG. 11.
Figures 14, 15, 16:
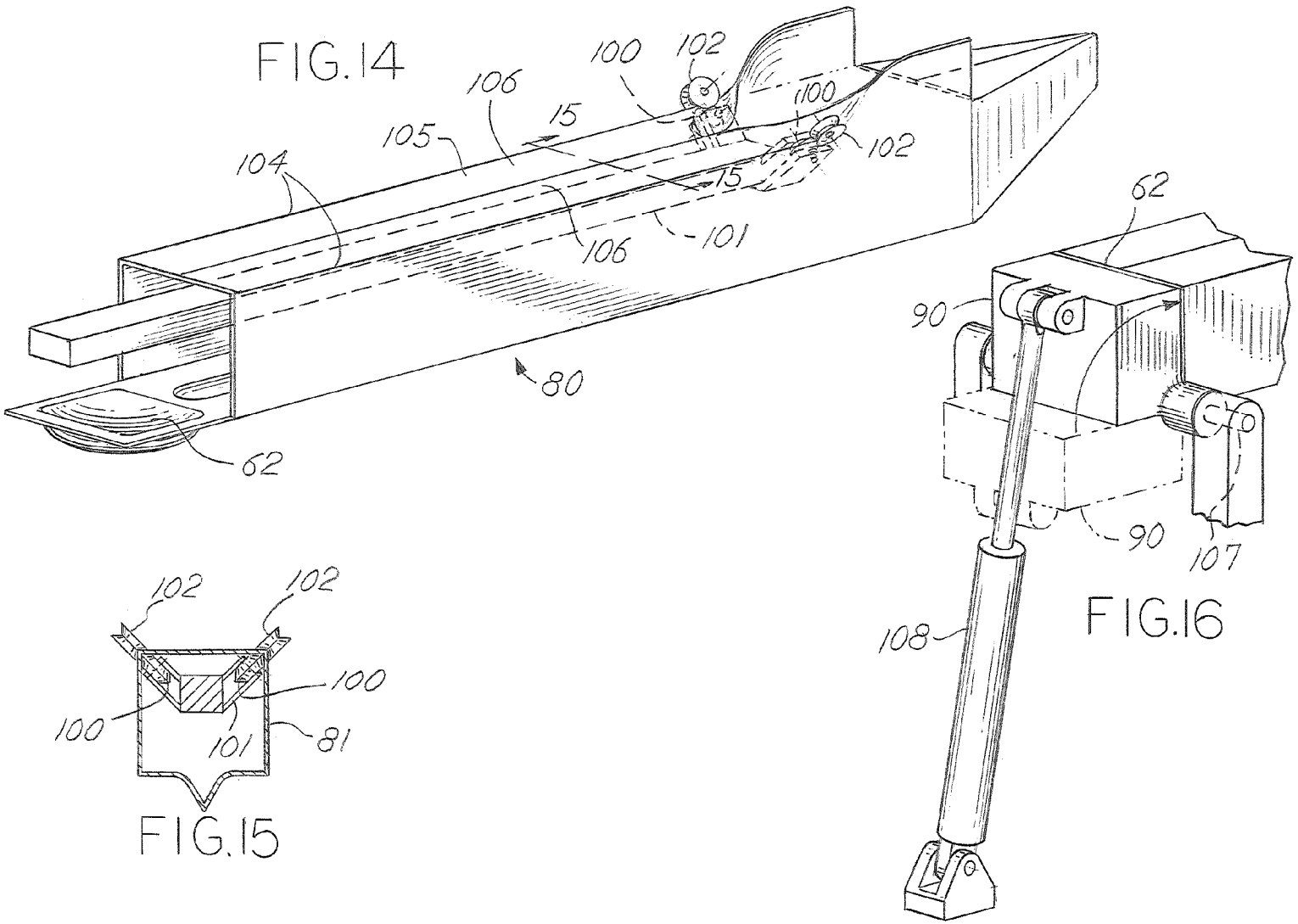
FIG. 14 is a perspective view of a forming operation on the top of the trough shown in FIG. 6.
FIG. 15 is a sectional view taken about the line 15-15 in FIG. 14.
FIG. 16 is a perspective view of the end cap being formed onto the pontoon.
Figure 17:
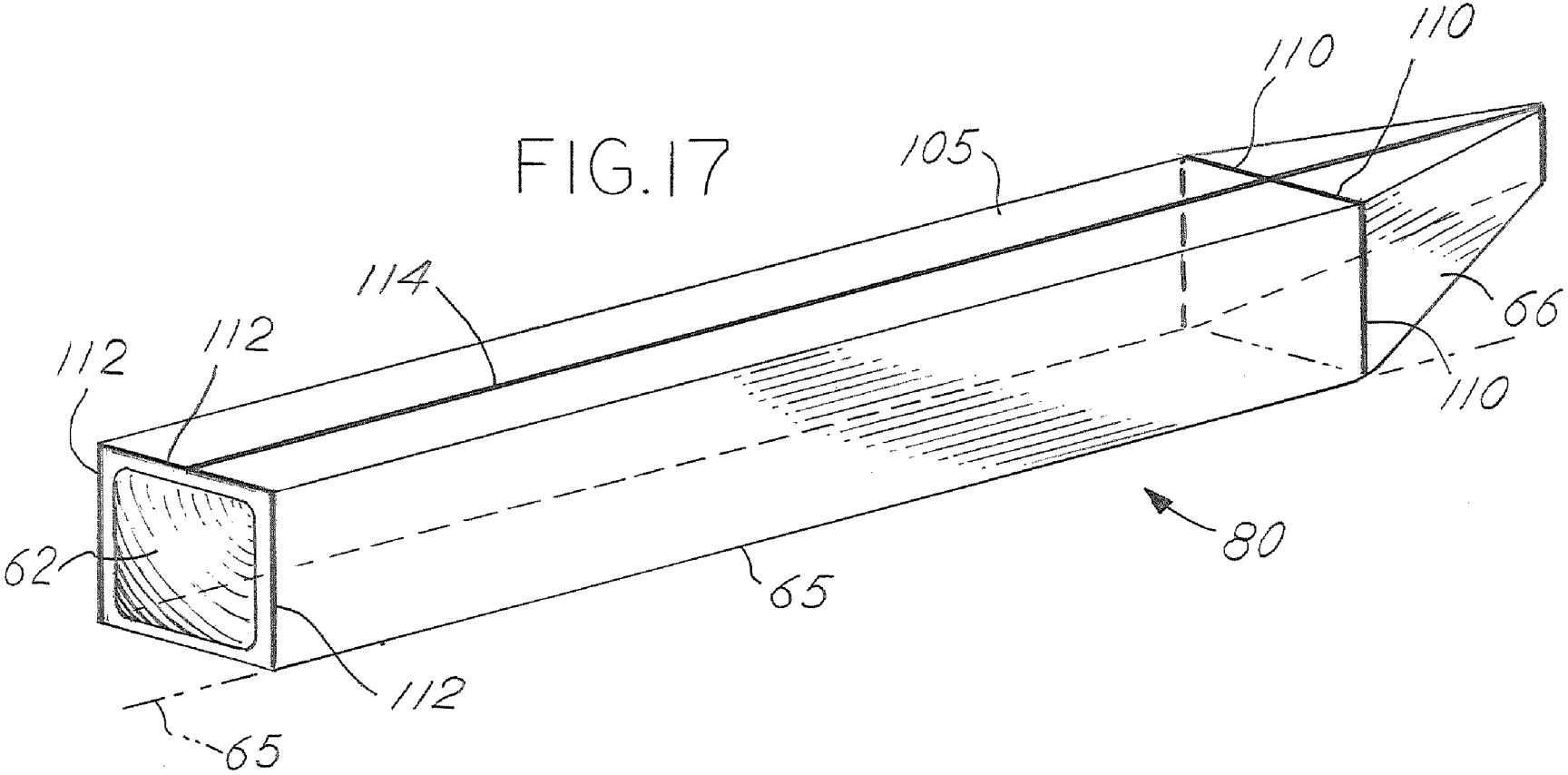
FIG. 17 is a perspective view of a finished pontoon made using a second application of the method.
Figure 18:
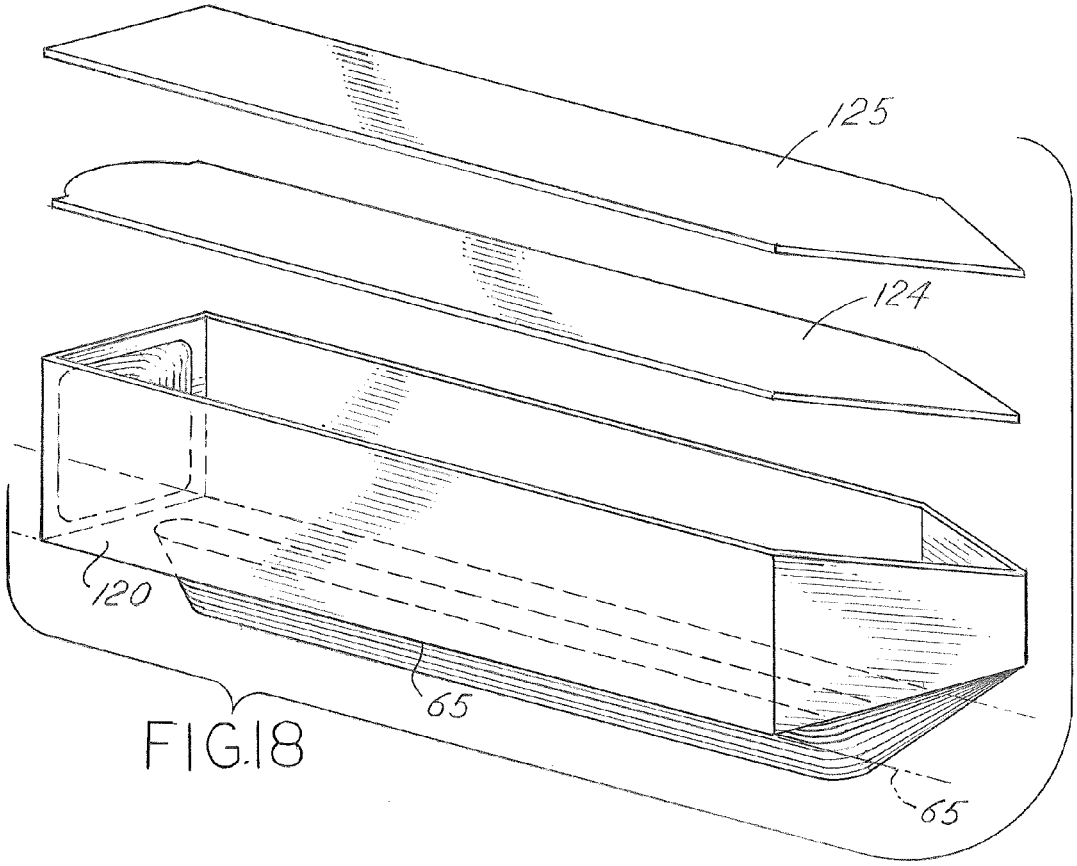
FIG. 18 is an exploded perspective view of a pontoon made using a third application of the method.

After the rough shapes of the end cap 62 and nose cone 66 are formed, a partial die 92 is inserted into the rough shape of the nose cone 66. The partial die 92 is shown in phantom in FIG. 11. The partial die 92 is shaped so that a support 93 from above protrudes through the open top of the trough 81. Rollers 94 are then passed over the sidewalls 95 of the nose cone 66 to form folds 96 that form the top flaps 98 of the nose cone, as shown in FIGS. 12 and 13. The partial die 92 is then pulled toward the rear of the trough 81 and may be removed from the nose cone 66. At this stage of the process, the rear of the pontoon 80 where the end cap 62 will be made remains open as shown in FIG. 14. A pair of internal rollers 100 on a roller frame 101 is inserted into the pontoon and a pair of mating external rollers 102 is pressed against both sides of the trough 81 to form folds 104 that define the top of the central portion 105. The external rollers 102 press inwardly on both sides simultaneously so that side loading is balanced on both sides of the roller frame 101, which results in a straight central portion 105. Once the top flaps 106 are formed, the roller frame 101 is removed through the rear of the pontoon 80.

At this stage of the process, the rough shape of the end cap 62 is against the rear die 90, and the only portion of the pontoon 80 that remains open is the rear end as shown in FIG. 16. The rear die 90 pivots about the axis of a rod 107. A hydraulic cylinder 108 is attached to the rear die 90. The hydraulic cylinder 108 is actuated which pivots the rear die 90 upward and folds the end cap 62 into place.

Welds 110 are then made where the nose cone 66 and central portion 105 meet. Welds 112 are made where the end cap 62 and central portion 105 meet. Also, a weld 114 is made down the center along the top of the pontoon 80. The pontoon 80 produced by this application of the method of this patent results in a pontoon having no welded joints below the waterline 65.

Figure 19:
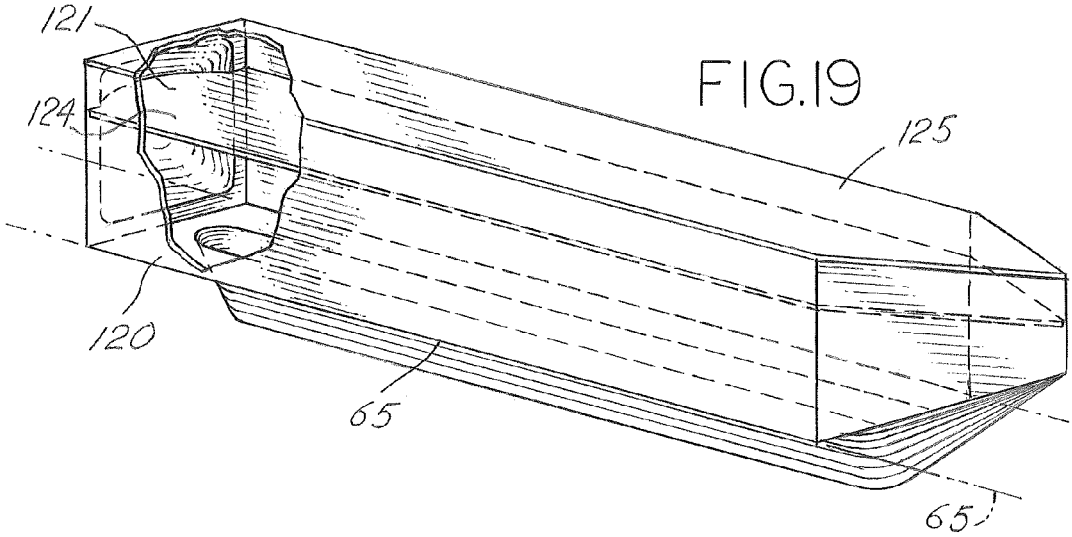
FIG. 19 is a perspective view of a finished pontoon using a third application of the method.

A third application of the method of this invention may be employed to produce pontoons that have no welds below the waterline and also have storage space within them. FIG. 19 shows a pontoon 120 having a storage space 121 within the pontoon. This pontoon 120 is made in the same manner as the pontoon 80 of the second application of the method, but the step of folding the sidewalls 36 is not performed. Instead a bottom panel 124 is placed between the sidewalls as shown in FIG. 19. The bottom panel 124 may be welded in place, and then a top cap 125 may be welded on top to complete the pontoon 120. If baffles such as those shown in FIG. 3 are desired to be placed below the bottom panel 124 to partition the lower portion of the pontoon 120 into separate chambers, the bottom panel 124 may be composed of separate parts that allow welds to be made along the top edges of the baffles. Many configurations of the pontoon 120 with storage space 121 are possible, including configurations that would allow fuel to be stored in the space 121, or having doors that provide access to the storage space 121 that allow below deck storage of large objects.

The invention is not limited to the details given above, but may be modified within the scope of the following claims.

What is claimed is:

1. A method for making a pontoon for a pontoon boat comprising the steps:

(a) providing a metal strip having a width, a length, and lateral edges;

(b) forming said metal strip longitudinally to provide a cross sectional shape in which the lateral edges of said strip are adjacent to each other;

(c) joining the lateral edges of the strip to produce a hollow central portion having a closed cross section and opposite ends; and (d) forming end caps from said opposite ends of said central portion to form an enclosed hollow pontoon said end caps being formed continuously from said metal strip so that a portion of said pontoon has no joints between said central portion and each said end cap.

2. A method for making a pontoon as claimed in claim 1, further comprising the step of cutting said closed cross sectional shape to a desired length.

3. A method for making a pontoon as claimed in claim 1, wherein one of said end caps is tapered.

4. A method for making a pontoon as claimed in claim 1, wherein said strip is formed longitudinally through successive rollers.

5. A method for making a pontoon as claimed in claim 2, wherein said central portion is a cylinder.

6. A method for making a pontoon as claimed in claim 2, further comprising the step of partitioning said central portion into separate chambers.

7. A method for a pontoon as claimed in claim 6, wherein rollers form said tapered end cap.

8. A method for making a pontoon as claimed in claim 7, wherein rollers fold said central portion.

9. A method for making pontoons as claimed in claim 1, wherein said end caps are stamped.

10. A pontoon made by the method of claim 1.

11. A pontoon made by the method of claim 1, wherein no joints are made below a waterline of the pontoon.

12. A method for making a pontoon as claimed in claim 1, wherein said lateral edges are joined by welding.

13. A method for making a pontoon as claimed in claim 1, wherein said end caps are joined by welding.

14. A method for making a pontoon for a pontoon boat as claimed in claim 1, wherein said end caps are formed separately and attached to said central portion.

15. A method for making a pontoon for a pontoon boat comprising the steps:

(a) providing a metal strip having a width, a length, and lateral edges;

(b) forming said metal strip longitudinally to provide a cross sectional shape in which the lateral edges of said strip are adjacent to each other;

(c) joining the lateral edges of the strip to produce a hollow central portion having a closed cross section and opposite ends;

(d) cutting said closed cross sectional shape to a desired length;

(e) partitioning said central portion into separate chambers; and (f) forming end caps from said opposite ends of said central portion to form an enclosed hollow pontoon, one of said end caps being tapered wherein rollers form said tapered end cap.

16. A method for making a pontoon as claimed in claim 15, wherein rollers fold said central portion.

17. A method for making a pontoon for a pontoon boat comprising the steps:

(a) providing a metal strip having a width, a length, and lateral edges;

(b) forming said metal strip longitudinally to provide a cross sectional shape in which the lateral edges of said strip are adjacent to each other;

(c) joining the lateral edges of the strip to produce a hollow central portion having a closed cross section and opposite ends; and (d) forming end caps from said opposite ends of said central portion to form an enclosed hollow pontoon wherein no joints are made below a waterline of said pontoon.

18. A method for making a pontoon as claimed in claim 17, wherein said lateral edges are joined by welding.

19. A method for making a pontoon as claimed in claim 17, wherein said end caps are joined by welding.

* * * * *